US005928382A

United States Patent [19]

Reinhardt et al.

[11] Patent Number: 5,928,382

[45] Date of Patent: Jul. 27, 1999

[54] BLEACHING COMPOSITION COMPRISING POLYOXOMETALLATES AS BLEACHING CATALYST

[75] Inventors: Gerd Reinhardt, Kelkheim; Vera Friderichs, Kesten; Bernd Scharbert; Rolf Peter Schulz, both of Frankfurt; Bernt Krebs, Münster; Rainer Böhner, Norden; Christian Thülig, Ahlen, all of Germany

[73] Assignee: Clariant GmbH, Frankfurt, Germany

[21] Appl. No.: 08/701,475

[22] Filed: Aug. 22, 1996

[30] Foreign Application Priority Data

Aug. 22, 1995 [DE] Germany ..... 195 30 786

[51] Int. Cl.[6] ..... D06L 3/02; C11D 3/00; C11D 7/18; C11D 7/54

[52] U.S. Cl. ..... 8/111; 252/186.26; 252/186.27; 252/186.3; 252/186.33; 252/186.38; 252/186.39; 510/367

[58] Field of Search ..... 8/111; 252/186.26, 252/186.27, 186.3, 186.33, 186.38, 186.39; 510/367

[56] References Cited

U.S. PATENT DOCUMENTS

| | | | |
|---|---|---|---|
| 5,041,142 | 8/1991 | Ellis | 8/111 |
| 5,114,611 | 5/1992 | Van Kralingen et al. | 252/186.33 |
| 5,208,369 | 5/1993 | Crump et al. | 562/106 |
| 5,227,084 | 7/1993 | Martens et al. | 252/95 |
| 5,482,515 | 1/1996 | Madison et al. | 8/111 |

FOREIGN PATENT DOCUMENTS

| | | |
|---|---|---|
| 0 301 723 | 2/1989 | European Pat. Off. . |
| 484 095 | 5/1992 | European Pat. Off. . |
| 195 30 787 | 2/1997 | Germany . |
| WO 86/02674 | 5/1986 | WIPO . |
| 94/05849 | 3/1994 | WIPO . |
| WO 94/05849 | 3/1994 | WIPO . |
| WO 94/20600 | 9/1994 | WIPO . |
| WO 95/27775 | 10/1995 | WIPO . |

OTHER PUBLICATIONS

Lyon et al. J. Amer. Chem. Soc. 1991, 113, 7209–7221, 7222–7226.

Lane et al. J. Amer. Chem. Soc. 1987, 109, 402–407.

Neumann et al. J. Amer. Chem. Soc. 1994, 116, 5509–5510.

European Patent Office Patent Abstract of Japan—06041593, 1994.

*Primary Examiner*—Mukund J. Shah
*Assistant Examiner*—Deepak R. Rao
*Attorney, Agent, or Firm*—Miles B. Dearth

[57] ABSTRACT

Bleach composition comprising one or more bleaching agents and one or more polyoxometallates of the formula $$(Q)_q(A_aX_xM_mO_yZ_z(H_2O)_b.cH_2O$$

as bleaching catalyst, the symbols Q, A, X, M, Z, q, a, x, m, y, z, b and c being as defined in the description.

14 Claims, No Drawings

BLEACHING COMPOSITION COMPRISING POLYOXOMETALLATES AS BLEACHING CATALYST

The active-oxygen bleach is a major constituent of modern detergents and cleaners. Its principal function is to remove stubborn stains, such as tea, coffee, red wine or fruit juice, from textile fibers or solid surfaces. It does this by oxidatively destroying the chromophoric system; at the same time, adhering microorganisms are killed and adhering odor substances are neutralized.

The bleaching or oxidizing agents used are generally hydrogen peroxide, or organic or inorganic peracids. In pulverulent detergents and cleaners, the source of hydrogen peroxide employed is in most cases a persalt.

In order to increase the efficiency of these detergents and cleaners in the temperature range from 40 to 60° C., bleach activators are often added to them. Examples of these are reactive carboxylic esters and carboxamides. Preference is given to tetraacetylethylenediamine (TAED), nonanoyloxybenzenesulfonate (NO BS), benzoyloxybenzenesulfonate (BOBS), diacetyldioxohexahydrotriazine (DADHT), pentaacetylglucose (PAG), nonanoyl- and benzoylcaprolactam, isatoic, maleic, succinic and citric anhydrides, acylated sugars or sugar derivatives, and alkane- or arenenitriles.

In the presence of the bleaching agent the bleach activators liberate the corresponding peracids, which usually have a broader spectrum of action than hydrogen peroxide.

In many cases, however, the combination of a bleaching agent with a bleach activator still does not produce optimum bleaching properties. Particular problems of such bleaching systems are their limited effectiveness at low temperatures, of less than 40° C., and their lack of reactivity toward certain stains.

Instead of the activator system (bleaching agent and bleach activator) it is also possible to use organic peroxycarboxylic acids directly as bleaching agents.

There is therefore a desire for bleach compositions by means of which the performance of the abovementioned compositions (i.e. bleaching agents or bleaching agent and bleach activator) can be increased further. For economic and environmental reasons, compounds with a catalytic action are preferred. In addition, however, there is also a requirement for bleaching catalysts which at low concentrations react directly with the inorganic persalt and thereby render the use of bleach activators superfluous.

It has been known for many years that transition metals in free or complexed form catalyze the decomposition of hydrogen peroxide. The activity of the compounds described to date, however, is unsatisfactory in the majority of cases. In many of these cases, although the addition of metal salts does lead to catalytic decomposition of the hydrogen peroxide, no bleaching effect is observed. This is usually associated with damage to the textile fabric. The occurrence of free transition metals during the washing and cleaning process, therefore, is undesirable. If the metal is used in complexed form, the complex involved must be stable to hydrolysis and oxidation during storage and under service conditions in order that these side-effects are suppressed.

The use of heteropoly acids for the oxidation of alkanes in organic solvents is known from EP-A-0 301 723. The use of vanadium-doped polyoxometallates in the paper industry is described in WO-94105849. J. Amer. Chem. Soc. 1991, 113, 7209–7221 and 7222–7226 describes the use of polyoxometallates for oxidizing olefins in organic solvents.

It has surprisingly now been found that polyoxometallates and/or poly acids are outstandingly suitable as bleaching catalysts in bleach compositions and that even in small, i.e. catalytic amounts they increase the effectiveness of bleaching agents, such as hydrogen peroxide, inorganic and organic peracids and Caroates.

The invention provides a bleach composition comprising one or more bleaching agents and one or more bleaching catalysts, wherein the bleaching catalysts present are polyoxometallates.

Polyoxometallates are inorganic metal-oxygen clusters with defined oligomeric or polymeric structural units which form spontaneously under appropriate conditions in an aqueous medium from simple compounds of vanadium, niobium, tantalum, molybdenum or tungsten (see M. T. Pope, Heteropoly and Isopoly Oxometalates, Springer-Verlag, Berlin, 1983).

Depending on their structure, the polyoxometallates are subdivided into isopoly- and heteropolyoxometallates.

Isopolyoxometallates are the most simple forms of polyoxometallates and can be described as binary, i.e. containing only metal ion and oxygen, oxide anions of the formula $[M_mO_y]^{p-}$. Typical examples of such isopolyoxometallates are $[Mo_2O_7]^{2-}$, $[W_6O_{24}]^{12}$, $[Mo_6O_{16}]^{2-}$ and $[Mo_{36}O_{112}]^{8-}$.

In contrast, heteropolyoxometallates also contain further nonmetal, semimetal and/or transition metal ions.

Heteropolyoxometallates of the general form $[X_xA_aM_mO_y]^{p-}$, where X is a nonmetal or semimetal ion and A is a transition metal ion, possess one or more so-called heteroatoms X and/or A. One example is $[PW_{12}O_{40}]^{3-}$ (where X=P). By substitution of $M_mO_y$ structural units in both isopoly- and heteropolyoxometallates for a transition metal ion A it is possible to introduce redoxidative transition metal ions of type A into the solid structures. Known examples include transition metal-doped, so-called Keggin anions of the formula $[APW_{11}O_{39}]^{7-/8-}$where A=Zn, Co, Ni, Mn (J. Amer. Chem. Soc., 113, 1991, 7209) and Dawson anions $[AP_2W_{17}O_{61}]^{7-/8-}$where A=Mn, Fe, Co, Ni, Cu (J. Amer. Chem. Soc. 109, 1987, 402), which may also contain bound water of crystallization. Further substitutions, including different transition metal ions, are known, for example $[WZnMn_2(ZnW_9O_{34})_2]^{12-}$(J. Amer. Chem. Soc. 116, 1994, 5509). The charge of the above-described anions is compensated by protons (thereby giving the corresponding poly acids) or by cations (formation of poly-acid salts= heteropolyoxometallates).

For simplicity, the term polyoxometallate as used in the descriptionembraces not only the salts of the poly acids but also the corresponding poly acids themselves.

The polyoxometallates used in accordance with the invention include not only the abovementioned polyoxometallates of the prior art but also those described in the German Application 195 30 787.9 of equal priority, which is expressly incorporated herein by reference.

The bleaching catalysts used in accordance with the invention preferably have the formula (1)

$$(Q)_q(A_aX_xM_mO_yZ_z(H_2O)_b).cH_2O \quad (1)$$

where Q, A, X, M, Z, q, a, x, m, y, z, b and c are defined as follows:

Q is one or more cations selected from the group consisting of H, Li, K, Na,

Rb, Cs, Ca, Mg, Sr, Ba, Al, $PR^1R^2R^3R^4$ and $NR^1R^2R^3R^4$, in which $R^1$, $R^2$, $R^3$ and $R^4$ are identical or different and are H, $C_1$–$C_{20}$-alkyl, $C_5$–$C_8$-cycloalkyl or $C_6$–$C_{24}$-aryl;

q is a number from 1 to 60, in particular from 1 to 40, and for monovalent countercations simultaneously describes the charge of the anionic unit;

A is one or more transition metals from subgroups 2 to 8, preferably Mn, Ru, V, Ti, Zr, Cr, Fe, Co, Cu, Zn, Ni, Re and Os, particularly preferably Mn, Ru, V, Ti, Fe, Co and Zn;

a is a number from 0 to 10, preferably from 0 to 8;

X is one or more atoms selected from the group consisting of Sb, S, Se, Te, Bi, Ga, B, P, Si, Ge, F, Cl, Br and I, preferably P, B, S, Sb, Bi, Si, F, Cl, Br and I;

x is a number from 0 to 10, preferably 0 to 8;

M is one or more transition metals selected from the group consisting of Mo, W, Nb, Ta and V;

m is a number from 0.5 to 60, preferably 4 to 10;

Z is one or more anions selected from the group consisting of $OH^-$, $F^-$, $Cl^-$, $Br^-$, $I^-$, $N_3^-$, $NO_3^-$, $ClO_4^-$, $NCS^-$, $SCN^-$, $PF_6^-$, $RSO_3^-$, $RSO_4^-$, $CF_3SO_3^-$, $BR_4^-$, $BF_4^-$, $CH_3COO^-$where R is H, $C_1$–$C_{20}$-alkyl, $C_5$–$C_8$-cycloalkyl or $C_6$–$C_{24}$-aryl;

z is a number from 0 to 10, preferably from 0 to 8;

O is oxygen;

y is the number of oxygen atoms required for structure/charge compensation, and b and c independently of one another are numbers from 0 to 50, preferably from 0 to 30.

In the above formula q, a, x, m, y, z, b and c are preferably integers in their respective ranges.

Particular preference is given to the following polyoxometallates:

$Q_8[MnMo_6O_{24}]$(Q=Na or $NMe_4$ or a mixture of both)
$K_4[MnMo_6O_8(OH)_6]$
$(NH_4)_{10}[Mn_3Sb_2W_{19}O_{68}]$*
$Na_{17}[Mn_2Se_6W_{24}O_{94}Cl]$*
$Na_2(NMe_4)_2[Mn_2W_{12}O_{40}(OH)_{12}].12H_2O$
$(Na/K)_{10}[Mn_3Se_2W_{18}O_{66}]$*
$Na_8[MnW_{12}O_{40}(OH)_2].6H_2O$
$Na_6[MnW_{12}O_{40}(OH)_2].6H_2O$
$Na_7[MnMo_9O_{32}]$*
$K_7[MnMo_9O_{32}]$*
*=containing water of crystallization.

These bleaching catalysts are normally added in granulated form to the bleach composition. In a preferred embodiment they are incorported into the bleach activator granules. Granulation auxiliaries which can be used are inorganic salts such as sodium sulfate, sodium chloride, sodium phosphate or silicates. Prior art inorganic or organic granulation auxiliaries can be used, preference being given to film-forming materials such as surfactants, fatty acids, cellulose derivatives or polymers. The granules can additionally be provided with a coating in order firstly to increase their shelf life and to prevent interactions with other detergent ingredients during storage and secondly to exert a positive effect on their dissolution kinetics.

In the novel compositions the bleaching catalysts are employed in combination with one or more bleaching agents, preferably from the class of organic and inorganic peracids, organic and inorganic persalts, hydrogen peroxide, Caro's acid and its salts (=Caroates).

Preferred organic peracids and persalts are a) monoperoxycarboxylic acids and their salts, such as peroxybenzoic acid, peroxynonanoic acid, peroxylauric acid and monoperoxyphthalic acid, b) diperoxycarboxylic acids and their salts, such as 2-alkylperoxy-1,4-butanedioic acid, 1,7-heptanediperoxycarboxylic acid, 1,9-nonanediperoxycarboxylic acid, 1,12-dodecanediperoxycarboxylic acid and diperoxyphthalic acid, c) peroxycarboxylic acids and their salts with an amide bond in the hydrocarbon chain, such as N-decanoylaminoperoxycaproic acid, 5-(N-nonylcarbamoyl)peroxyvaleric acid and 3-(N-nonylcarbamoyl)peroxypropionic acid, d) sulfonylperoxycarboxylic acids and their salts, such as 4,4'-sulfonyldiperoxybenzoic acid, 3,3'-sulfonyldiperoxypropionic acid, 4-methylsulfonylperoxybenzoic acid and 3-decylsulfonylperoxypropionic acid, and e) unsubstituted, mono- or polysubstituted phthaloylaminoperoxycarboxylic acids of the formula

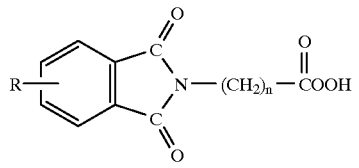

where R is hydrogen, chlorine, bromine, $C_1$–$C_{20}$-alkyl, $C_1$–$C_{20}$-alkenyl, aryl, preferably phenyl or alkaryl, preferably $C_1$-$C_4$-alkylphenyl, and n is an integer from 1 to 20, for example N,N'-phthaloylaminoperoxy-n-hexanoic acid (PAP) and N,N'-phthaloylaminoperoxylauric acid.

Preferred inorganic persalts are the perborates, percarbonates, perphosphates and persulfates of alkali metals. If the bleaching catalysts are employed in pulverulent products, particularly preferred bleaching agents are perborates, such as sodium perborate monohydrate or tetrahydrate, percarbonates, such as sodium percarbonate, Caro's acid or salts of Caro's acid in the form of the triple salt.

The bleaching agents can be used either with the novel bleaching catalysts alone or, in a preferred embodiment, in combination with a bleach activator. This widens the scope for application and strengthens the microbicidal properties of the novel compositions.

The bleaching agents which can be employed without bleach activator include, preferably, the abovementioned organic bleaching agents. The use of a bleach activator is particularly advantageous with inorganic bleaching agents.

The term bleach activators refers to compounds which in aqueous solutions comprising hydrogen peroxide or persalts react to form peracids with a bleaching action. Suitable bleach activators are in principle all known bleach activators, including, in particular, N-acylated amines, N-acylated diamines, N-acylated amides and glycolurils, as are known, for example, from DE-B-12 91 317, DE-A-20 38 106 and DE-B-11 62 967. Examples of these are tetraacetylmethylenediamine, tetraacetylethylenediamine, diacetylaniline, diacetyl-p-toluidine, 1,3-diacetyl-5,5-dimethylhydantoin, tetraacetylglycoluril, tetrapropionylglycoluril, 1,4-diacetyl-2,5-diketopiperazine, 1,4-diacetyl-3,6-dimethyl-2,5-diketopiperazine and diacetyldioxohexahydrotriazine (DADHT).

Further suitable bleach activators are prior art acyloxybenzenesulfonates, such as nonanoyloxybenzenesulfonate (NOBS) and benzoyloxybenzenesulfonate (BOBS), acylated sugars, such as pentaacetylglucose (PAG), sugar derivatives, such as sugar amides, activated carboxylic esters, carboxylic anhydrides, such as isatoic, maleic, succinic and citric anhydride, lactones, acylals, acyllactams, such as nonanoyl and benzoylcaprolactam, alkanenitriles and arenenitriles.

In addition to the bleaching agent, bleaching catalyst and, if used, bleaching activator, the novel bleach compositions can also comprise further additives from the groups consisting of surface-active compounds, such as anionic, nonionic, zwitterionic, amphoteric or cationic surfactants, builders, cobuilders, enzymes and additives.

Surfactants can be of natural or synthetic origin and are described, for example, in "Surface Active Agents and Detergents" Volume I and II by Schwartz, Perry and Berch. Examples are alkyl sulfates, alkylsulfonates, alkylarylsulfonates, alpha-sulfo fatty acid methyl esters, soaps and alkyl ether sulfonates. Nonionic surfactants, such as alkyl polyglycol ethers, alkylpolyglucosides, glucamides, sugar esters and amine oxides, can also be used.

Important builders and cobuilders are phosphates, such as sodium polyphosphate, zeolites of type A, X and P, alkali metal carbonates and alkali metal hydrogen carbonates, amorphous and crystalline silicates, especially phyllosilicates, such as SKS-6, SKS-7, SKS-9 and SKS-10 from Hoechst AG (Germany) or disilicates, as marketed by Akzo under the tradename Britesil. Cobuilders which can be used include organic carboxylic acids, such as citric acid or amino acids, but also polymers of the polyacrylic acid type or copolymers of acrylic acid and maleic acid and derivatives thereof. It is also possible to add phosphonates or other complexing agents.

Enzymes which can be used are amylase, proteases, lipases, cellulases and peroxidases, while other additives include cellulose ethers, silicones, bentonites, fluorescent whiteners and fragrances.

The novel bleach compositions generally comprise from 1 to 99.9995% by weight, preferably from 5 to 99.999% by weight, of one or more bleaching agents, from 0.0005 to 2% by weight, preferably from 0.001 to 0.5% by weight, of one or more bleaching catalysts, from 0 to 70% by weight, preferably from 10 to 60% by weight, of a bleach activator and, if desired, further additives to 100% by weight of the composition.

The novel bleach compositions are used in detergents and cleaners, for example heavy duty detergents, multicomponent detergents (modular systems), scouring salts, stain pretreatment products, dishwasher rinse aids, cleaners for hard surfaces, disinfectants and cleanser for false teeth. In addition to bleaching, the bleaching catalysts used in accordance with the invention also take over the function of dye transfer inhibitors.

The polyoxometallates used in accordance with the invention possess catalytic properties and are able, in combination with one or more bleaching agents, to increase the bleaching power of the latter by a multiple, especially in the washing and cleaning process, without damaging the fibers. A further advantage of the bleaching catalysts used in accordance with the invention is that they do not give rise to any problems as regards biodegradability.

The novel bleach compositions consisting of bleaching catalyst, bleaching agent and, if used, bleaching activator are customarily employed in the detergents and cleaners in the following concentrations:

Heavy duty detergents from 2 to 40% by weight

Scouring salts and laundry pretreatment products: from 20 to 100% by weight

Dishwasher rinse aids: from 1 to 30% by weight

Cleaners for hard surfaces, and disinfectant cleaners: from 2 to 50% by weight

Cleanser for false teeth: from 2 to 20% by weight.

The novel bleach compositions can be added in the form of a powder or as granules to the detergents and cleaners.

EXAMPLES

For performance testing, the following catalysts were used.

Example 1

$(NH_4)_{10}[Mn_3Sb_2W_{19}O_{68}]^*$ (K-1)

50 g of sodium tungstate dihydrate are dissolved in 200 ml of water, and a solution of 2.5 g of antimony(III) oxide in 30 ml of concentrated hydrochloric acid is slowly added dropwise. A solution of 5 g of manganese(II) chloride tetrahydrate in 100 ml of water is then added to the first solution. The reaction mixture is adjusted to a pH of 7.5 by adding sodium carbonate and is stirred at 50° C. for 10 minutes. By adding 2 g of ammonium chloride in 20 ml of water, orange crystals are precipitated. The composition is determined by means of single-crystal structural analysis.

Example 2

Polyoxytungstate with Mn and Se (K-2)

A solution of 7.5 mmol of manganese(II) nitrate and 7.5 mmol of manganese(II) acetate in 120 ml of 1-normal hydrochloric acid is added dropwise to a solution of 0.12 mol of sodium tungstate dihydrate and 15 mmol of selenic acid in 200 ml of water. The mixture is stirred at room temperature for 2 hours, an excess of solid cesium chloride (6.8 g) is added, the mixture is filtered after 24 hours and the precipitate is washed with saturated CsCl solution. Drying in vacuo gives 3.8 g of a brown powder.

Example 3

Polyoxytungstate with Mn and Se (K-3)

A solution of 7.5 mmol of manganese(II) nitrate and 7.5 mmol of manganese(II) acetate in 120 ml of 1-normal hydrochloric acid is added dropwise to a solution of 0.12 mol of sodium tungstate dihydrate and 15 mmol of selenic acid in 200 ml of water. The mixture is stirred at room temperature for 2 hours, an excess of solid potassium chloride (3.0 g) is added, the mixture is filtered after 24 hours and the precipitate is washed with saturated CsCl solution. Drying in vacuo gives 2.4 g of a brown powder.

Example 4

$Na_2(NMe_4)_2[Mn_2W_{12}O_{40}(OH)_2].12\ H_2O$ (K-4)

A solution of 1.5 mmol of manganese(II) nitrate in 12 ml of 1-normal hydrochloric acid is added dropwise to a solution of 12 mmol of the salt $Na_2WO_4$ and 1.5 mmol of selenous acid in 20 ml of water. After stirring at 25° C. for two hours, a solution of 1.5 mmol of tetramethylammonium bromide is added. The mixture is left to stand at 0° C., and 1.0 g of pale brown crystals is obtained. Elemental analysis reveals the composition to be $Na_2(NMe_4)_2[Mn_2W_{12}O_{40}(OH)]_2.12\ H_2O$

Example 5

$Na_{17}[Mn_2Se_6W_{24}O_{94}Cl]^*$ (K-5)

50 g of sodium tungstate dihydrate, 4.5 g of selenous acid and 8 g of manganese(II) chloride tetrahydrate are dissolved in 500 ml of a 1-normal buffer solution (acetic acid/sodium acetate). After stirring at 25° C. for 5 minutes, the solution is filtered, and slow concentration of the filtrate to remove the solvent enables orange crystals to be isolated. The composition is determined by means of single-crystal structural analysis.

Example 6

$K_7[MnMo_9O_{32}]^*$ (K-6)

Procedure as in Example 5. In contrast to Example 5, precipitation was carried out using 60 ml of a 1-normal KCl solution in water. Mo/Mn ratio corresponds to 9:1, no selenium present, no ESR signal, IR (KBr) 874, 895, 914, 930 $cm^{-1}$.

Performance tests:

I) Stability of hydrogen peroxide in the presence of polyoxometallate catalysts 0.5 g of sodium perborate monohydrate is dissolved in 1 l of water (15° German hardness [dH]) and the solution is temperature-conditioned at 20° C. Following the addition of 4 mg of manganese sulfate or the same amount of the bleaching catalysts set out below, the concentration of hydrogen peroxide is monitored over time by iodometric titration.

TABLE 1

| | Content of hydrogen peroxide in the solution | | | |
|---|---|---|---|---|
| | 0 min. | 10 min. | 20 min. | 30 min. |
| no addition | 100% | 100% | 99% | 99% |
| $Mn_2SO_4$ | 100% | 75% | 42% | 23% |
| K-1 | 100% | 100% | 99% | 98% |
| K-2 | 100% | 100% | 99% | 98% |
| K-3 | 100% | 100% | 98% | 98% |

The results show that the polyoxometallates used in accordance with the invention, unlike free manganese ions, do not cause uncontrolled decomposition of hydrogen peroxide.

II) Washing experiments in the Linitest apparatus 2 g/l of test detergent (phosphate-free, WMP, Krefeld Laundry Research Institute [WFK]) are dissolved in 200 ml of water (15° dH). Then 1 g/l of sodium percarbonate and 0.5 g/l of TAED and in each case 4 swatches of a soiled test fabric (tea on cotton, BC-1, WFK) are added. The washing experiments are carried out at 40° C. in a Linitest apparatus from Heraeus, Hanau, for a washing period of 30 minutes. The whiteness of the laundry is then determined using an Elrepho instrument (from Datacolor). The experiments are then carried out with the addition of 10 mg/l of a bleaching catalyst.

Table 2 lists the differences in reflectance (ΔRE).

TABLE 2

| Catalyst | ΔRE |
|---|---|
| none added | 0 |
| K-1 | +3.8 |
| K-2 | +1.3 |
| K-3 | +2.2 |
| K-4 | +2.5 |
| K-5 | +2.0 |
| K-6 | +1.9 |

The results show the positive effect of the novel catalysts on the bleaching process.

III) Effect of different oxidizing agents on bleaching

The washing experiments were carried out in the Linitest apparatus at 20° C.

Water hardness: 15° dH

Washing time: 30 minutes

Soiling: tea on cotton (BC-1)

Detergent: 1.5 g/l WMP detergent

Bleaching agents: 0.5 g/l phthalimidoperoxycaproic acid (PAP) 0.25 g/l sodium benzoyloxybenzenesulfonate (BOBS) in combination with 0.5 g/l of sodium perborate monohydrate 0.5 g/l potassium peroxomonosulfate (Caroate)

TABLE 3

| | | ΔRE | | |
|---|---|---|---|---|
| | | PAP | BOBS | Caroate |
| K-2 | without | +9.2 | +8.7 | +5.8 |
| | with | +9.8 | +10.2 | +7.1 |
| K-4 | without | +8.7 | +9.2 | +5.9 |
| | with | +10.7 | +9.8 | +6.7 |
| K-5 | without | +10.8 | — | +8.0 |
| | with | +11.4 | — | +8.2 |

The results show that the bleaching catalysts used in accordance with the invention, even at low concentrations, are capable of increasing the bleaching power of various bleaching agents at 20° C.

IV) Effect of the test soiling on the bleaching effect

The procedure of Section III was followed. Instead of the tea on cotton soiling, however, red wine on cotton was used. The test oxidizing agent was Caroate.

| Catalyst | ΔRE |
|---|---|
| none | 0 |
| K-1 | +1.1 |
| K-3 | +0.6 |
| K-4 | +2.4 |
| K-5 | +1.1 |

It can be seen that the use of the novel catalysts enables the bleaching effect of Caroate to be improved even with red wine soiling.

We claim:

1. A bleach composition comprising one or more bleaching agent and a polyoxometallate having the formula $$(Q)_q(A_aX_xM_mO_yZ_z(H_2O)_b).cH_2O$$

where Q, A, X, M, Z, q, a, x, m, y, z, b and c are defined as follows:

Q is one or more cations selected from the group consisting of H, Li, K, Na, Rb, Cs, Mg, Sr, Ba, Al, P $R^1R^2R^3R^4$ and $NR^1R^2R^3R^4$, in which $R^1$, $R^2$, $R^3$, and $R^4$ are identical or different and are H, $C_1$–$C_{20}$-alkyl, $C_5$–$C_8$- cycloalkyl or $C_6$–$C_{24}$-aryl;

q is a number from 1 to 40, and for monovalent countercations simultaneously describes the charge of the anionic unit;

A is one or more transition metals from subgroups 2 to 8 selected from the group consisting Mn, Ru, Vi, Ti, Zr, Cr, Fe, Co, Cu, Zn, Ni, Re and Os;

a is a number from 1to 10;

X is one or more atoms selected from the group consisting P, B, S, Sb, Bi, Si, F, Cl, Br and I;

x is a number from 0 to 8;

M is one or more transition metals selected from the group consisting of Mo, W, Nb, Ta, and V;

m is a number from 0.5 to 40;

Z is one or more anions selected from the group consisting of $OH^-$, $F^-$, $Cl^-$, $Br^-$, $I^-$, $N_3^-$, $NO_3^-$, $ClO_4^-$, $NCS^-$, $SCN^-$, $PF_6^-$, $RSO_3^-$, $RSO_4^-$, $CF_3SO_3^-$, $BR_4^-$, $BF_4^-$, $CH_3COO^-$ where R is H, $C_1$–$C_{20}$-alkyl, $C_5$–$C_8$-cycloalkyl or $C_6$–$C_{24}$-aryl;

z is a number from 0 to 8;

O is oxygen;

y is the number of oxygen atoms required for structure/charge compensation, and b and c independently of one another are numbers from 0 to 30.

2. A bleach composition as claimed in claim 1, wherein the bleaching agent is hydrogen peroxide, organic peracids, inorganic peracids, organic persalts, inorganic persalts, Caro's acid and Caroates.

3. A bleach composition as claimed in claim 1, wherein the bleaching agent is selected from the group consisting of monoperoxycarboxylic acids, diperoxycarboxylic acids, peroxycarboxylic acids with an amide bond in the hydrocarbon chain, sulfonylperoxycarboxylic acids and phthaloylaminoperoxycarboxylic acids of the formula

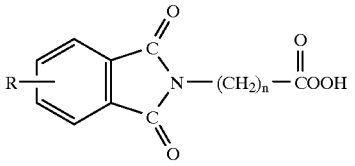

where R is hydrogen, chlorine, bromine, $C_1$–$C_{20}$-alkyl, $C_1$–$C_{20}$-alkenyl, aryl, alkaryl,and n is an integer from 1 to 20.

4. A bleach composition as claimed in claim 1, wherein the bleaching agent is selected from the group consisting of alkali metal perborates, alkali metal percarbonates, alkali metal perphosphates and alkali metal persulfates.

5. A bleach composition as claimed in claim 1, which additionally contains one or more bleach activators.

6. A bleach composition as claimed in claim 1, which additionally contains a bleach activator selected from the group consisting of N-acylated amines, N-acylated diamines, N-acylated amides, glycolurils, acyloxybenzenesulfonates, acylated sugars, sugar derivatives, activated carboxylic esters, activated carboxamides, carboxylic anhydrides, lactones, acylals, acyllactams, alkanenitriles and arenenitriles.

7. The bleach composition as claimed in claim 1 wherein A is selected from the group consisting of Mn, Ru, V, Ti, Fe, Co, and Zn.

8. A bleach composition as claimed in claim 1, which comprises from 1 to 99.9995% by weight, of one or more bleaching agents, from 0.0005 to 2% by weight, of one or more bleaching catalysts, from 0 to 70% by weight, of one or more bleach activators and, optionally, further additives to 100% by weight of the composition.

9. The bleach composition as claimed in claim 8 which comprises 5 to 99.99% by weight of said bleaching agents, from 0.001 to 5% by weight of said bleaching catalysts, and from 10 to 60% by weight of said bleach activators.

10. A method of using the bleach composition of claim 2 comprising incorporating said bleach composition into a detergent.

11. A method of using the bleach composition of claim 2 comprising incorporating from 2 to 50% by weight of said bleach composition into a cleaner used for cleaning or disinfecting surfaces.

12. A method of using the bleach composition of claim 2 comprising incorporating from 20 to 100% of said bleach composition into a laundry pretreatment product.

13. A method of using the bleach composition of claim 1 comprising incorporating from 2 to 20% by weight of said bleach composition into a cleaner used for cleaning false teeth.

14. A process for bleaching a textile comprising treating said textile with the bleaching composition of claim 1.

* * * * *